United States Patent [19]

Wiggin

[11] Patent Number: 4,699,160

[45] Date of Patent: Oct. 13, 1987

[54] HAIR CURLING ROD ASSEMBLY

[76] Inventor: Elizabeth T. Wiggin, 746 Pan Am Ave., Naples, Fla. 33963

[21] Appl. No.: 11,361

[22] Filed: Feb. 2, 1987

Related U.S. Application Data

[63] Continuation of Ser. No. 800,407, Nov. 21, 1985, abandoned.

[51] Int. Cl.[4] ..... A45D 2/14

[52] U.S. Cl. ..... 132/42 A; 132/42 R; 132/40

[58] Field of Search ..... 132/7, 40, 36.2 B, 42 R, 132/42 A; D28/37

[56] References Cited

U.S. PATENT DOCUMENTS

| | | | |
|---|---|---|---|
| 1,839,668 | 1/1932 | Gaire . | |
| 2,369,752 | 2/1945 | Ostrander | 132/40 |
| 2,395,965 | 3/1946 | Grant | 132/42 |
| 2,677,380 | 5/1954 | Schoendorf | 132/36.2 B |
| 2,723,671 | 11/1955 | Amendola | 132/7 |
| 2,732,845 | 1/1956 | Winkler | 132/40 |
| 2,896,638 | 7/1959 | Korsmo | 132/42 |
| 2,906,273 | 9/1959 | Beauregard | 132/7 |
| 2,991,790 | 7/1961 | Bonilla | 132/7 |
| 3,045,685 | 1/1962 | Cormier | 132/42 |
| 3,376,875 | 4/1968 | Rosan | 132/40 |
| 3,451,398 | 6/1969 | Marcello | 132/7 |
| 3,717,156 | 2/1973 | McKeown | 132/40 |
| 4,108,183 | 8/1978 | Mauro | 132/42 A |
| 4,240,451 | 12/1980 | Thompson | 132/42 A |
| 4,286,608 | 9/1981 | Handley et al. | 132/40 |
| 4,465,085 | 8/1984 | Schopieray | 132/42 A |
| 4,515,171 | 5/1985 | Thibodeaux | 132/42 R |

FOREIGN PATENT DOCUMENTS

| | | | |
|---|---|---|---|
| 75789 | 4/1983 | European Pat. Off. | 132/42 A |
| 2107581 | 5/1983 | United Kingdom | 132/42 A |

*Primary Examiner*—Robert P. Swiatek
*Assistant Examiner*—J. Hakomaki
*Attorney, Agent, or Firm*—Merrill N. Johnson

[57] ABSTRACT

A hair curling rod assembly consisting of an elongated hollow rod molded of thermoplastic material and having one closed end and an opposite open end, the open end of the rod having a cylindrical opening and the closed end of the rod having an axial hole in the center of its closed end, a hair tress-fastening cord of stretchable elastomeric material passing through the axial hole in the closed end of the rod with the end of the cord lying within the hollow rod being knotted so as to secure it within said rod, the closed end of the rod also having along its outer rim a plurality of grooves equally spaced around the rim, these grooves being sized to snugly contain the tress-fastening cord as the cord is stretched from one end to the other of the rod, and a cylindrical plug sized to fit into the cylindrical opening in the rod and having an axial hole through which passes the opposite end of the cord with that end of the cord then knotted so as to retain the plug onto the cord. Preferably the outer surface of the rod contains a series of similar raised ridges generally parallel to each other running from one end of the rod to the other and also four rows of cylindrical drain holes running from one end of the rod to the other.

4 Claims, 5 Drawing Figures

HAIR CURLING ROD ASSEMBLY

This is a continuation of co-pending application Ser. No. 800,407 filed on Nov. 21, 1985, now abandoned.

BACKGROUND AND SUMMARY OF THE INVENTION

The present invention relates to hair curling appartus in which stretchable elastomeric cords are used to hold the curled hair tresses against the curlers.

A variety of forms of such apparatus have been suggested as evidenced by U.S. Pat. Nos. 2,395,965; 2,677,380; 2,896,638; 3,045,685; 4,108,183 and 4,515,171. Millions of hair curling devices have been and are being used with generally satisfactory results both by persons curling their own hair at home and by professional operators in beauty shops.

However, as a professional beauty shop operator, I have found that all the hair curling devices I have used fail to give the best possible results for a number of reasons.

First, the outer surface of the curling rod often fails to contact some of the hairs of the tress being wound up onto the rod, resulting in the tress being unevenly wound onto the rod or painful pulling of the hair on unwinding.

Secondly, many rods fail to provide means to insure that the tress wound upon the curling rod will receive and be permeated first with the waving solution and then with the rinsing water.

Thirdly, and by far the most important, existing devices do not permit the operator or user to precisely locate the desired position of the elastomeric cord across the tress wound upon the rod. The operator usually desires the cord to lie over the hair last wound upon the rod so that no portion of the wound tress will subsequently become unwound until the cord is removed.

Fourthly, many curling devices do not provide quick, simple and positive locking of the stretched cord into the opposite end of the curling rod.

I have invented an improved hair curling rod assembly which overcomes the foregoing deficiencies. By providing a curling rod with a series of similar raised ridges in its outer surface which run generally parallel to each other from one end to the other end of the rod, my rod will contact and retain the individual hairs evenly and without painful tangling of the tress being wound upon the rod or later unwound.

By providing four rows of spaced drain holes running the length of each rod, adequate circulation of the waving solution and rinse water throughout each wound tress is assured.

Most important, by having one end of the elastomeric cord anchored at the middle of the closed end of the rod and by providing a series of cord-holding grooves spaced around the rim of the closed end of the rod, the operator is able to precisely locate and fix the position of the cord across the wound tress. And by having the opposite end of the cord secured within the center of a plug which fits into the opposite end of the rod, the operator can be sure that the cord will lie across the wound tress parallel with the central axis of the rod.

Lastly, by securing the opposite end of the cord within a cylindrical plug which fits securely within the open end of the rod, the operator is insured of a quick and easy locking of the cord in its desired position and that the cord will not slip out and release its grip on the wound tress during subsequent waving and rinsing of the hair.

BRIEF DESCRIPTION OF THE DRAWINGS

A preferred embodiment of my invention is illustrated in the drawings in which.

DETAILED DESCRIPTION OF THE PREFERRED EMBODIMENT

Figure 1:
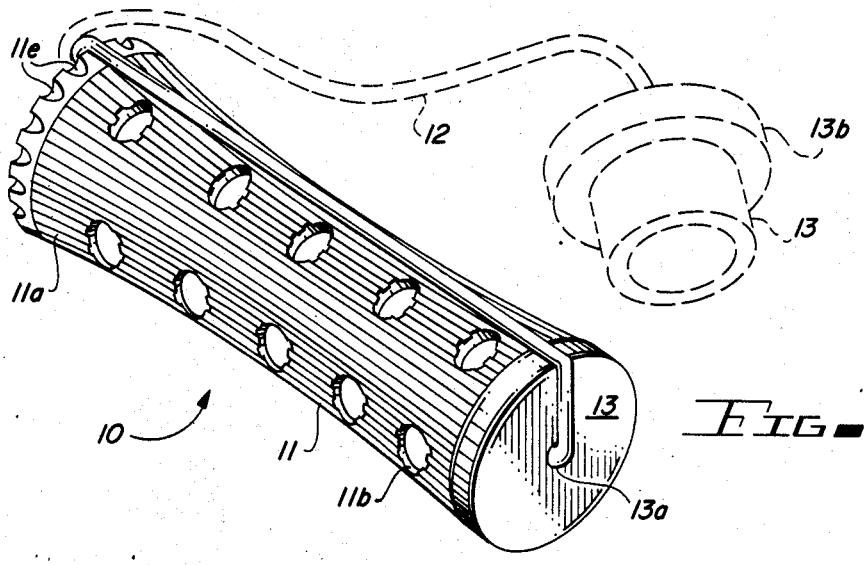
FIG. 1 is a perspective view of the hair curling rod assembly with its plug inserted into the end of the rod and with the plug and cord uninserted shown in dotted lines.
Figure 2:
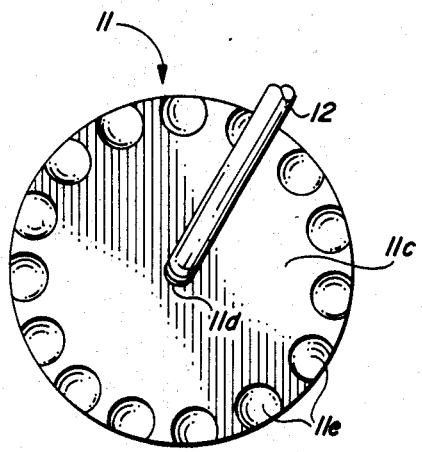
FIG. 2 is an end view of the closed end of the rod with the elastomeric cord held within one of the grooves in the rim of the closed end of the rod.

Referring first to FIG. 1 of the drawings, the preferred embodiment of my hair curling rod assembly 10 includes a hollow curling rod 11 in the general form of an elongated cylinder. Preferably rod 11 is molded of a suitable thermoplastic material such as polystyrene. The assembly includes two additional members, cord 12 made of natural or synthetic rubber or other stretchable elastomeric material and flanged cylindrical plug 13 which, like rod 11, is preferably molded of thermoplastic material.

Figure 3:
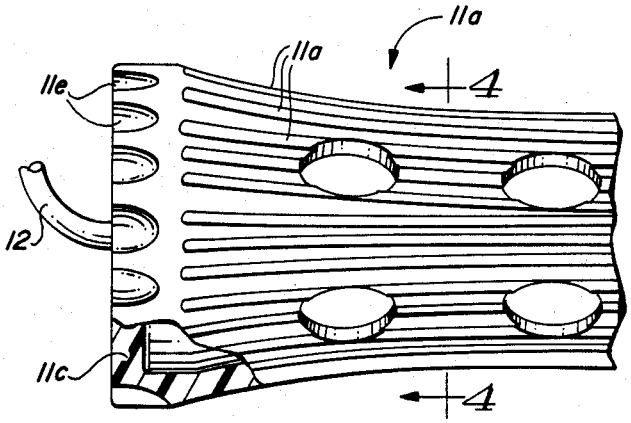
FIG. 3 is a side view of the closed end of the rod partially broken away to show the construction of the grooves in the rim of the rod.

As can best be seen in FIGS. 1 and 3, the outer surface of rod 11 is concave, that is, the diameter of the rod gradually increases from its middle toward both of its opposite ends. This form permits the hair tress to be wound upon the rod so that when the winding is completed, the outer surface of the wound tress will lie substantially parallel to the central axis of the rod, thus assuring maximum contact between the tress and the hair-fastening cord.

Figure 4:
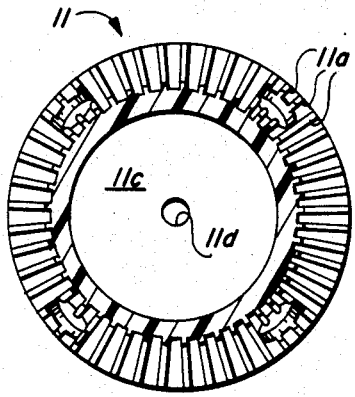
FIG. 4 is a cross-sectional view of the curling rod taken along line 4—4 in FIG. 3 showing the raised ridges along the outer surface of the rod.

To promote smooth and even winding of the tress onto rod 11, the outer surface of the rod contains a series of identical raised ridges **11*a* (best shown in FIG. 4**) which run generally parallel to each other across the rod's outer surface from one end of the rod to the other.

To insure thorough wetting and rinsing of all the hair wound on the rod, the rod includes four identical rows of cylindrical holes **11*b*** from the outer surface to the inside of the hollow rod.

One end of rod 11 is closed by an integral cylindrical end piece **11*c* lying perpendicular to the central axis of the rod. End piece 11*c* has an axially bored hole 11*d* at its center. A plurality of not less than twelve identical semicircular grooves 11*e* are equally spaced around the outer rim of end piece 11*c*. Semicircular grooves 11*e* are sized to snugly confine cord 12 when the cord is stretched from one end to the other of the rod as shown in FIG. 1**.

Figure 5:
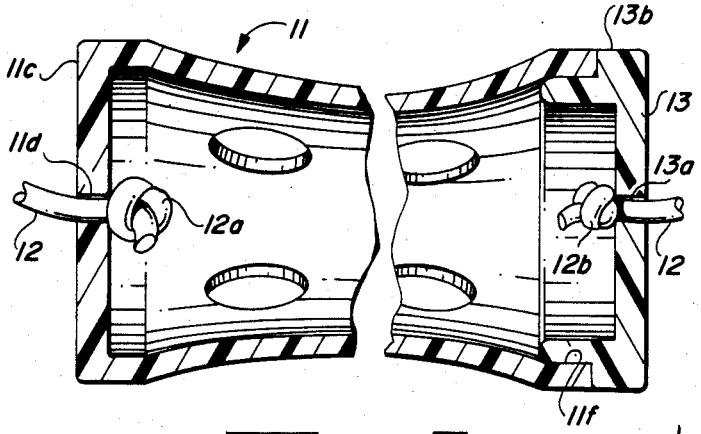
FIG. 5 is a cross-sectional view partially broken away showing the opposite ends of the rod, the plug inserted into the open end of the rod, and the fastening of the elastomeric cord into the closed end of the rod and into the plug.

One end of elastomeric cord 12 is passed through axial hole **11*d* into the inside of hollow rod 11 and the end is then tied into a knot 12*a* to secure cord end within the rod. The opposite end of the cord is then threaded through an axially bored hole 13***a* in the center of the plug. After passing through hole 13*a* the end of the cord is tied into a knot 12*b* as shown in FIG. 5.

Plug 13 is sized to fit easily into the cylindrical opening 11*f* in the open end of rod 11. The length of elastomeric cord 12 between its knotted ends 12*a* and 12*b* is chosen so that the cord must be stretched and is still extended beyond its normal length when plug 13 is fitted into the cylindrical opening 11*f* in the open end of the rod. Plug 13 includes a radially extending flange 13*b* which fits firmly against the open end of the rod when the plug is inserted into opening 11*f*.

In use, my hair curling rod assembly 10 is held by the operator or user with the plug dangling loosely from cord 12 as shown in dotted lines in FIG. 1. The end of a hair tress is placed against the raised ridges 11*a* of the rod and the tress rolled upon the rod.

When the tress has been rolled up to the point desired by the operator or user, the operator or user grasps plug 13 and stretches cord 12 and then places cord 12 into the one semicircular groove 11*e* which will place cord 12 over that portion of the rolled tress desired to be fastened by the cord.

The operator or user then positions the cord parallel to the raised ridges 11*a* and the central axis of the rod and inserts plug 13 into the rod's cylindrical opening 11*f*. Thus cord 12 will lie straight across the rolled tress at the point selected by the operator or user. An equally important, plug 13 will be locked securely into opening 11*f*, thus continuing to keep stretched cord 12 pressed against the tress rolled onto rod 11.

While I have shown and described in detail a preferred embodiment of my unique hair curling rod assembly, it should be understood that my invention is in no way limited by such description, and its scope is determined only by the following claims.

I claim:

1. A hair curling rod assembly comprising an elongated one-piece hollow rod of rigid thermoplastic material whose diameter gradually increases from its middle toward its outer ends, the outer surface of said rod containing a plurality of similar ridges generally parallel to each other running from one end to the other of said rod, said rod also containing four rows of cylindrical drain holes running from one end to the other of said rod, one end of said hollow rod being closed by an integral flat cylindrical disc having an axial hole in the middle of said disc, the other end of said hollow rod having a cylindrical opening therein, a hair tress-fastening elastomeric cord passing through said axial hole and the end of said cord inside said rod being enlarged so as to secure said end of the cord within said hollow rod, the cylindrical disc enclosing one end of said rod having along its outer rim a plurality of not less than twelve cylindrical grooves equally spaced around the outer rim of said closed end, each of said grooves being sized to snugly contain in place and to locate the tress-fastening cord as it is stretched from one end to the other of said rod, and a cylindrical plug sized to fit into the cylindrical opening in the rod and having a rod-engaging flange and an axial hole in its center through which an end of the elastomeric cord passes and its end enlarged so as to retain the plug onto the cord.

2. A hair curling rod assembly as set forth in claim 1 in which the outer rim of the rod contains sixteen semicircular grooves.

3. A hair curling rod assembly comprising a rigid one-piece elongated hollow rod having one closed cylindrical end and an opposite open end, the outer surface of said rod having a series of identical raised ridges lying generally parallel to each other and running from one to the other end of said rod, said rod containing several rows of circular drain holes running from one to the other end of said rod, each row containing at least five holes, the open end of said rod having a cylindrical opening, the closed cylindrical end of said rod having an axial hole in its center, a hair tress-fastening cord of stretchable elastomeric material passing through said axial hole with the end of said cord lying within said hollow rod being enlarged so as to secure said end within said rod, said closed cylindrical end of the rod also having along its outer rim a plurality of grooves equally spaced around said rim, said grooves being sized to snugly contain and to locate the tress-fastening cord as said cord is stretched from the closed end to the opposite open end of said rod, and a flanged cylindrical plug sized to fit into the cylidrical opening in the rod and having an axial hole in said plug through which passes the opposite end of the cord with said end of the cord then enlarged so as to retain the plug onto the cord.

4. A hair curling rod assembly as set forth in claim 3 in which the outer rim of the rod contains sixteen semicircular grooves.

* * * * *